US012780468B2

(12) United States Patent
Hendricks et al.

(10) Patent No.: US 12,780,468 B2
(45) Date of Patent: Nov. 3, 2026

(54) END FLAP ENGAGING ASSEMBLY, RELATED SYSTEMS AND METHODS

(71) Applicant: Graphic Packaging International, LLC, Atlanta, GA (US)

(72) Inventors: Timothy W. Hendricks, Acworth, GA (US); Carlos Molina Pena, Atlanta, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 19/207,768

(22) Filed: May 14, 2025

(65) Prior Publication Data

US 2025/0353628 A1 Nov. 20, 2025

Related U.S. Application Data

(60) Provisional application No. 63/647,702, filed on May 15, 2024.

(51) Int. Cl.
*B65B 27/04* (2006.01)

(52) U.S. Cl.
CPC ..... *B65B 27/04* (2013.01)

(58) Field of Classification Search
CPC ..... B65B 27/04; B65B 13/08; B65B 17/025; B65B 49/10
See application file for complete search history.

(56) References Cited

U.S. PATENT DOCUMENTS 3,415,033 A 12/1968 Perry
3,698,151 A 10/1972 Arneson
3,751,872 A 8/1973 Helms
3,848,519 A 11/1974 Ganz
3,940,907 A 3/1976 Ganz
4,100,715 A 7/1978 Ganz
(Continued)

FOREIGN PATENT DOCUMENTS

DE 102009043863 A1 3/2011
DE 102018102514 A1 8/2019
(Continued)

OTHER PUBLICATIONS

International Search Report and Written Opinion issued in App. No. PCT/US2025/029292, dated Aug. 28, 2025, 11 pages.

*Primary Examiner* — Thomas M Wittenschlaeger
(74) *Attorney, Agent, or Firm* — Andrew N. Claerbout; FisherBroyles, LLP

(57) ABSTRACT

A method of engaging at least one end flap of a carrier includes moving the carrier below an end flap engagement assembly along a product path, activating a drive apparatus to cause an end flap tucking apparatus to move in a machine direction, engaging a first cam follower of the end flap tucking apparatus with a first cam track to cause vertical movement of at least one tucking finger of the end flap tucking apparatus relative to the carrier, engaging a second cam follower of the end flap tucking apparatus with a second cam track to cause movement of the at least one tucking finger of the end flap tucking apparatus along the machine direction relative to the remainder of the end flap tucking apparatus, and contacting and moving at least one end flap of the carrier with the at least one tucking finger of the end flap tucking apparatus.

23 Claims, 15 Drawing Sheets

(56) References Cited

U.S. PATENT DOCUMENTS

| | | | | |
|---|---|---|---|---|
| 4,240,239 | A * | 12/1980 | Stelzner | B65B 17/025 53/48.5 |
| 4,802,324 | A | 2/1989 | Everson | |
| 4,871,070 | A | 10/1989 | Langen | |
| 5,626,002 | A * | 5/1997 | Ford | B65B 21/242 53/48.7 |
| 5,910,090 | A | 6/1999 | Taute | |
| 6,381,927 | B1 | 5/2002 | Moncrief | |
| 7,093,408 | B2 | 8/2006 | Duperray | |
| 7,645,113 | B2 | 1/2010 | Hendricks | |
| 7,779,606 | B2 * | 8/2010 | Ford | B65B 21/242 53/448 |
| 11,225,384 | B2 | 1/2022 | Karst | |
| 11,390,049 | B2 | 7/2022 | Langen | |
| 11,752,723 | B2 | 9/2023 | Langen | |
| 12,083,764 | B2 | 9/2024 | Langen | |
| 12,172,787 | B2 | 12/2024 | Langen | |
| 2004/0068961 | A1 | 4/2004 | Chalendar | |
| 2006/0042188 | A1 | 3/2006 | Ford | |
| 2006/0207220 | A1 | 9/2006 | Ford | |
| 2007/0084149 | A1 | 4/2007 | Jorissen | |
| 2007/0277481 | A1 | 12/2007 | LeBras | |
| 2008/0011581 | A1 | 1/2008 | Ford | |
| 2010/0018156 | A1 | 1/2010 | Ford | |
| 2011/0154784 | A1 | 6/2011 | Poutot | |
| 2011/0173930 | A1 | 7/2011 | Poutot | |
| 2011/0192116 | A1 | 8/2011 | Bachelle | |
| 2013/0042580 | A1 | 2/2013 | May | |
| 2013/0111855 | A1 | 5/2013 | Hendricks | |
| 2016/0194104 | A1 | 7/2016 | Jorissen | |
| 2018/0022487 | A1 | 1/2018 | Morselli | |
| 2022/0204195 | A1 | 6/2022 | Evers | |
| 2025/0026573 | A1 | 1/2025 | Hendricks | |
| 2025/0074709 | A1 | 3/2025 | Hendricks | |

FOREIGN PATENT DOCUMENTS

| | | | |
|---|---|---|---|
| DE | 102018102515 | A1 | 8/2019 |
| EP | 2986513 | B1 | 10/2018 |
| ES | 2411955 | R1 | 8/2013 |
| WO | 1999014123 | A1 | 3/1999 |
| WO | 03024803 | A3 | 7/2003 |
| WO | 2011038323 | A3 | 6/2011 |
| WO | 2011127367 | A1 | 10/2011 |
| WO | 2013083865 | A1 | 6/2013 |
| WO | 2016196278 | A1 | 12/2016 |
| WO | 2023059735 | A2 | 4/2023 |

* cited by examiner

END FLAP ENGAGING ASSEMBLY, RELATED SYSTEMS AND METHODS

CROSS-REFERENCE TO RELATED APPLICATION

The present application claims priority to U.S. Provisional Patent Application No. 63/647,702, filed on May 15, 2024, entitled End Flap Engaging Assembly, Related Systems and Methods.

INCORPORATION BY REFERENCE

The disclosures of each of U.S. Provisional Patent Application No. 63/647,702, filed on May 15, 2024, entitled End Flap Engaging Assembly, Related Systems and Methods, and U.S. patent application Ser. No. 18/535,165, filed on Dec. 11, 2023, entitled Carrier for Containers, are hereby incorporated by reference for all purposes as if set forth in their entireties.

BACKGROUND OF THE DISCLOSURE

The present disclosure generally relates to end flap engaging assemblies, and methods and systems related thereto, for at least partially forming carriers from blanks.

SUMMARY OF THE DISCLOSURE

According to one aspect, the disclosure is generally directed to a method of engaging at least one end flap of a carrier comprises moving the carrier below an end flap engagement assembly along a product path parallel to a machine direction of the end flap engagement assembly, activating a drive apparatus to cause an end flap tucking apparatus to move in the machine direction, engaging a first cam follower of the end flap tucking apparatus with a first cam track to cause vertical movement of at least one tucking finger of the end flap tucking apparatus relative to the carrier, engaging a second cam follower of the end flap tucking apparatus with a second cam track to cause movement of the at least one tucking finger of the end flap tucking apparatus along the machine direction relative to the remainder of the end flap tucking apparatus, and contacting and moving at least one end flap of the carrier with the at least one tucking finger of the end flap tucking apparatus.

According to another aspect, the disclosure is generally directed to a product packaging system, comprising an upstream end, a downstream end, a machine direction extending from the upstream end to the downstream end, a machine frame, an end flap engagement assembly supported on the machine frame. The end flap engagement assembly comprises a drive apparatus, an end flap tucking apparatus movably supported on the drive apparatus, the end flap tucking apparatus comprising a first cam follower, a second cam follower, and at least one tucking finger for contacting and moving at least one end flap of a carrier, a first cam track at least partially receiving the first cam follower such that movement of the first cam follower along the first cam track is for causing vertical movement of at least one tucking finger of the end flap tucking apparatus relative to the carrier, and a second cam track at least partially receiving the second cam follower such that movement of the second cam follower along the second cam track is for causing vertical movement of at least one tucking finger of the end flap tucking apparatus relative to the carrier.

According to another aspect, the disclosure is generally directed to an end flap engagement assembly for engaging a carrier, comprising an end flap tucking apparatus comprising a first cam follower, a second cam follower, and at least one tucking finger for contacting and moving at least one end flap of the carrier, a first cam track at least partially receiving the first cam follower such that movement of the first cam follower along the first cam track is for causing vertical movement of at least one tucking finger of the end flap tucking apparatus relative to the carrier, and a second cam track at least partially receiving the second cam follower such that movement of the second cam follower along the second cam track is for causing vertical movement of at least one tucking finger of the end flap tucking apparatus relative to the carrier.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to a system and method of preparing/processing a blank, product carrier, or other construct for further processing and/or for forming packages and/or carriers for holding products such as containers, e.g., food and beverage containers. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Product carriers according to the present disclosure can include containers of numerous different shapes. In this specification, the terms "lower," "bottom," "upper" and "top" indicate orientations determined in relation to fully erected product carriers.

Figure 1:
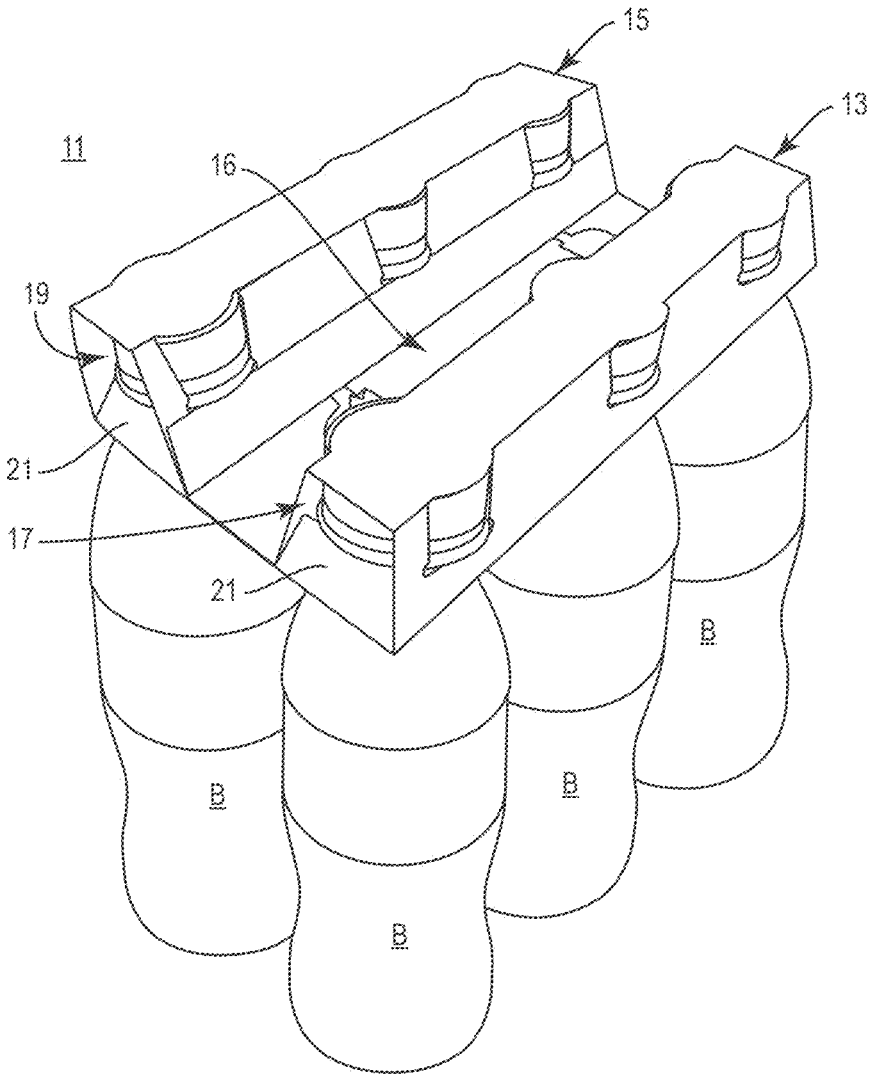
FIG. 1 is a perspective view of a carrier and package for being used with systems and methods according to the present disclosure.

Referring to FIG. 1, a product package or carrier or product carrier 11 formed from a blank and at least partially receiving one or more containers, such as bottles B, is illustrated. As shown, each product carrier 11 can include a front portion 13, a back portion 15, and a central portion 16 extending from the front portion 13 to the back portion 15. Each of the front portion 13 and the back portion 15 of the product carrier 11 can at least partially receive a portion of a respective container B therethrough.

Figure 2:
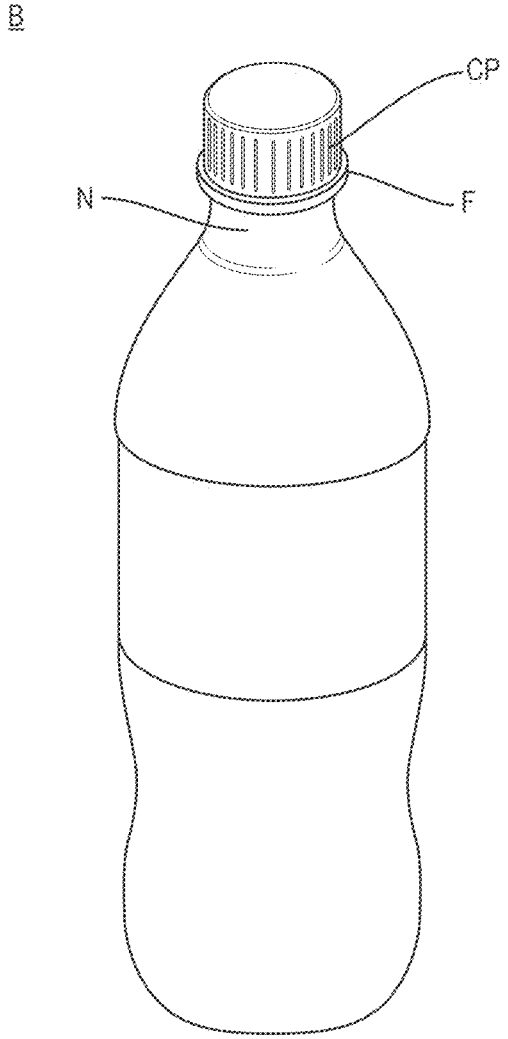
FIG. 2 is a perspective view of a container of the type suitable for use with the package and carrier of FIG. 1.

Referring momentarily to FIG. 2, containers B for being received by the packages/carriers 11 can be bottles, e.g., plastic bottles formed of polyethylene terephthalate (PET) or another polymer, and having upper portions that include an at least partially tapered neck portion N intersecting a flange F that at least partially supports a cap CP. In other embodiments, the containers B could be beverage cans or another suitable type and size of container.

Each of the front portion 13 and the back portion 15 of the product carrier 11 can include a plurality of panels and/or end flaps that at least partially extend around the respective portions of the bottles B, e.g., at least portions of one or more of the cap CP, flange F, and neck portion N thereof, so as to at least partially define a front interior recess 17 in the front portion 13 of the product carrier 11 and a back interior recess 19 in the back portion 15 of the product carrier 11.

As shown, a plurality of end flaps of the product carrier 11 can be foldably connected to a respective panel of the plurality of panels of the product carrier 11. In the illustrated embodiment, a plurality of end flaps 21 can be foldably connected to the respective front portion 13 of the product carrier 11 and the back portion 15 of the product carrier 11. The end flaps 21 can be for being folded at least partially into the respective interior recess 17, 19 for at least partially engaging a respective container B adjacent a respective end of the product carrier 11. In some embodiments, the end flaps 21 can be for extending to an underside of a respective flange F of a respective container B to provide a tightened engagement of the product carrier 11 and the containers B.

The product carrier 11 can be of a type described in U.S. patent application Ser. No. 18/535,165, filed on Dec. 11, 2023, entitled Carrier for Containers, the entire contents of which are incorporated by reference herein as if set forth in its entirety. It will be understood that the carrier can have a different configuration without departing from the disclosure.

Figure 3:
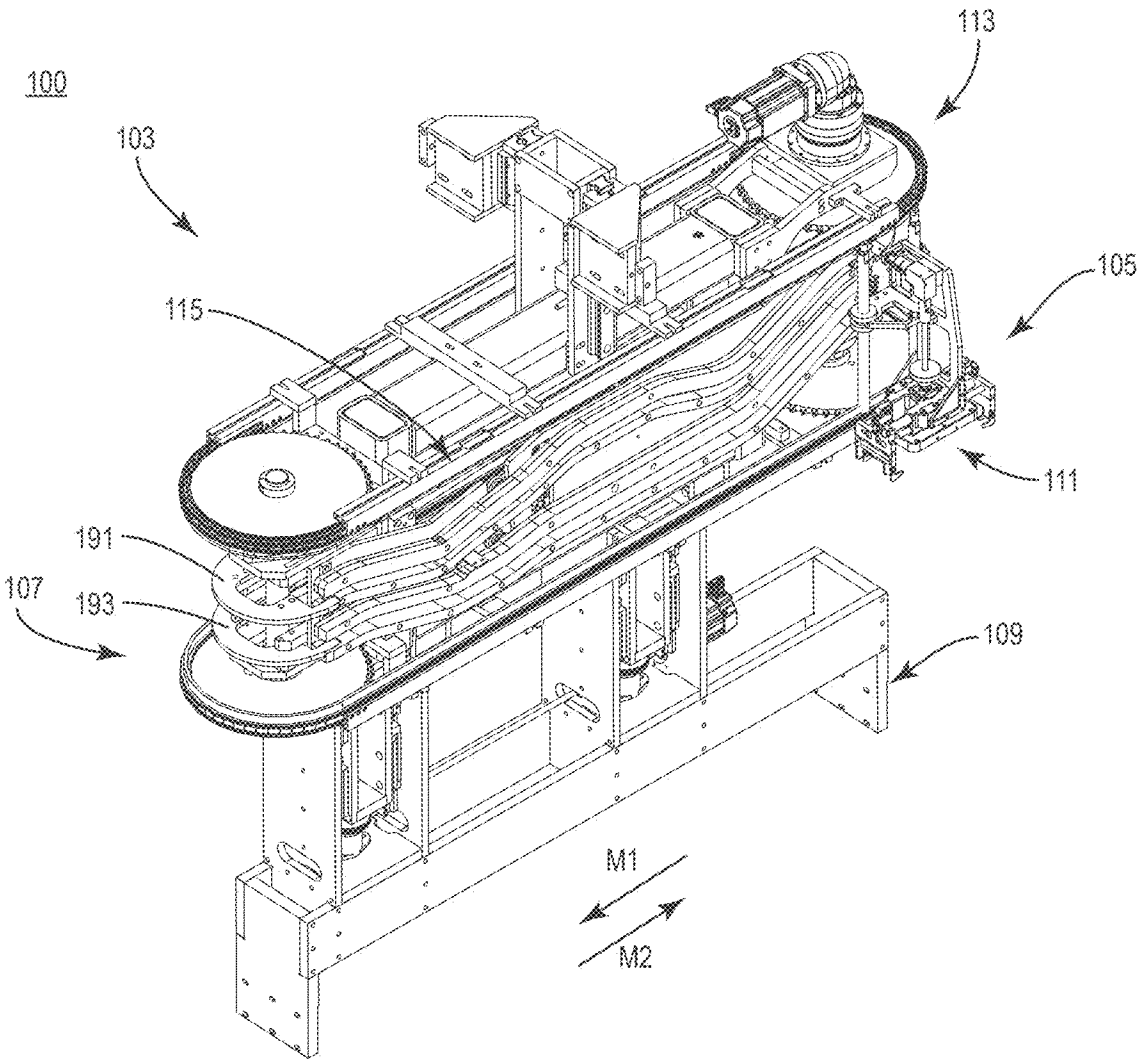
FIG. 3 is a perspective view of a product packaging system according to an exemplary embodiment of the disclosure.
Figure 4:
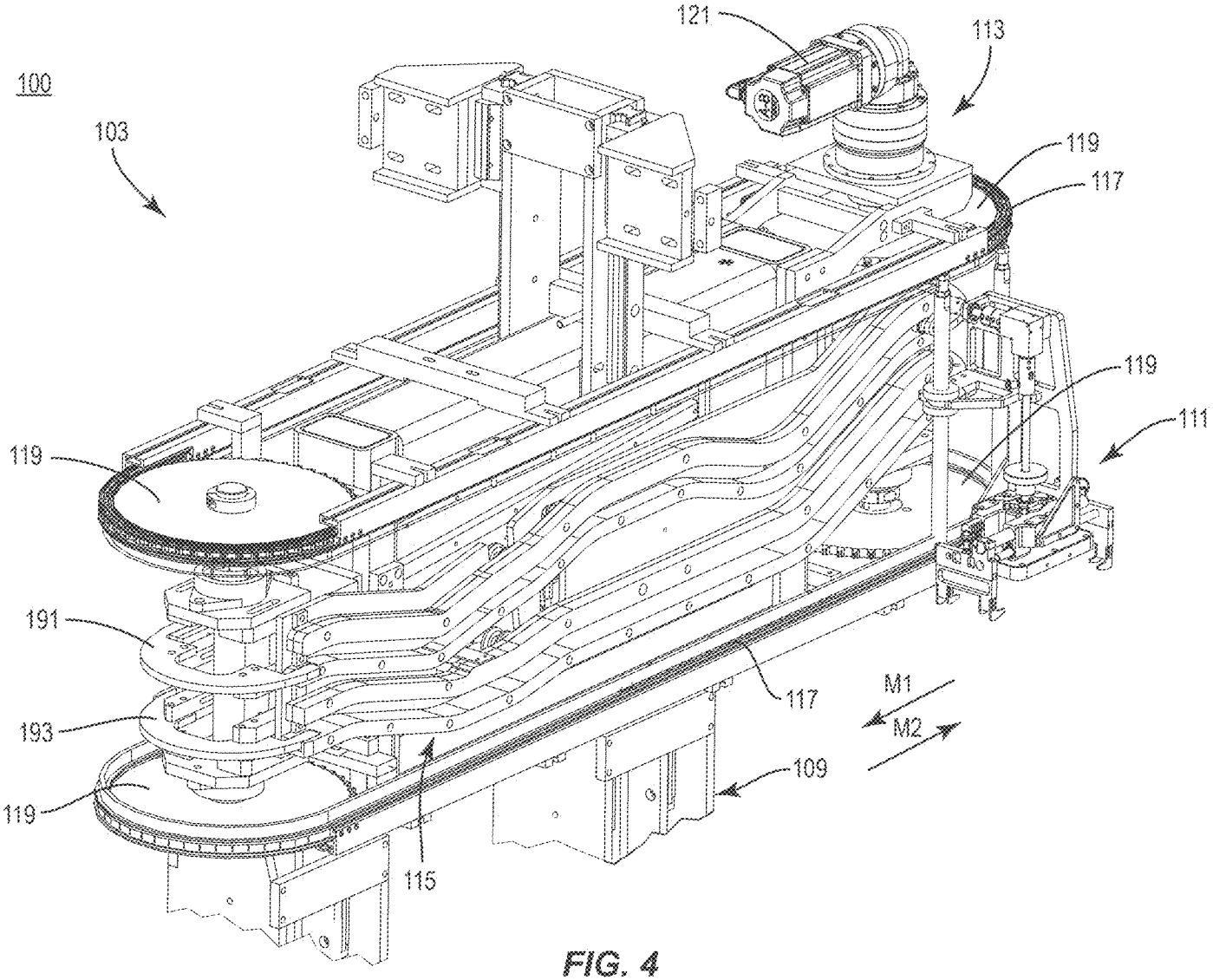
FIG. 4 is an enlarged perspective view of a portion of the product packaging system of FIG. 3.
Figure 5:
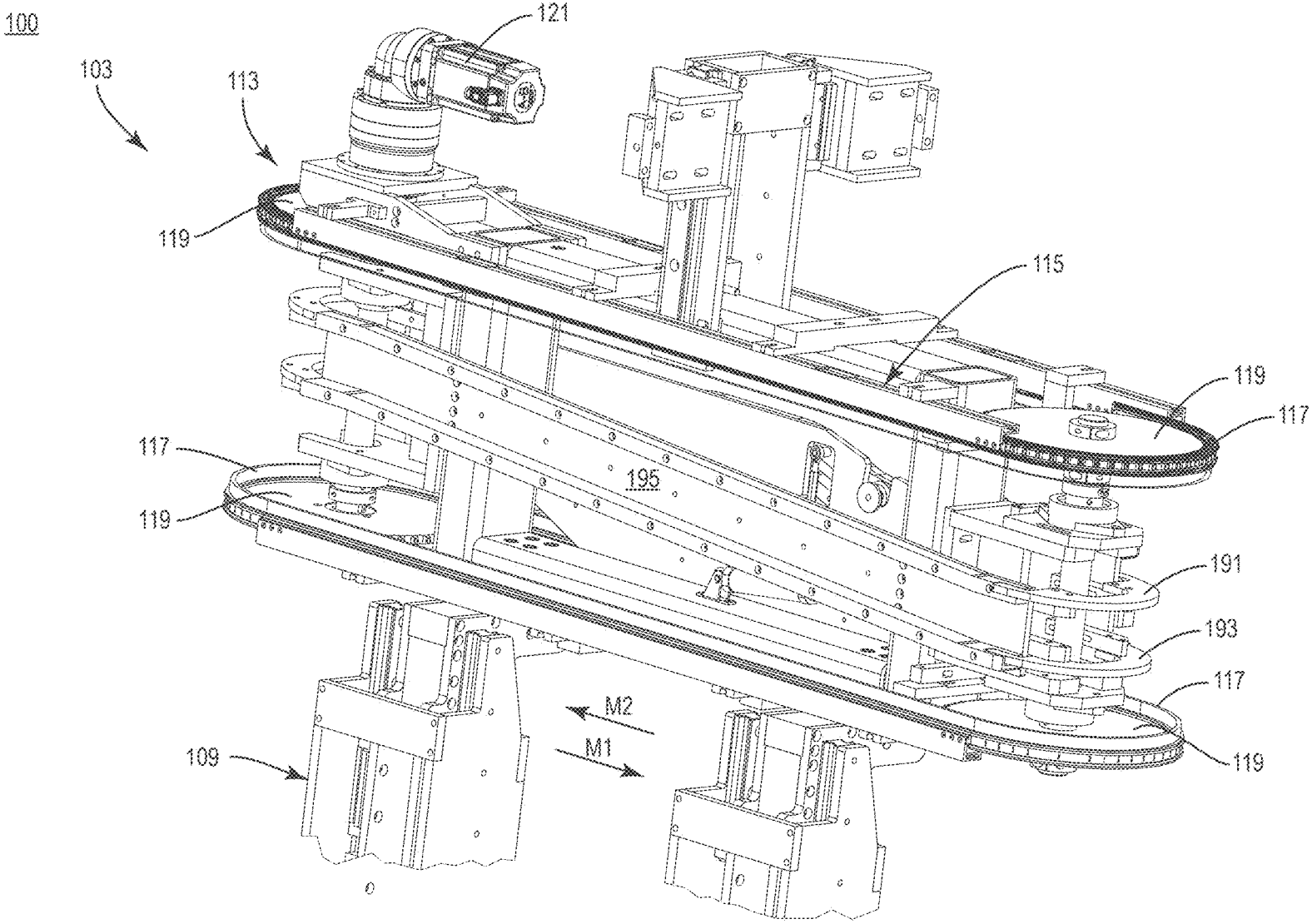
FIG. 5 is an enlarged perspective view of another portion of the product packaging system of FIG. 3.
Figure 6:
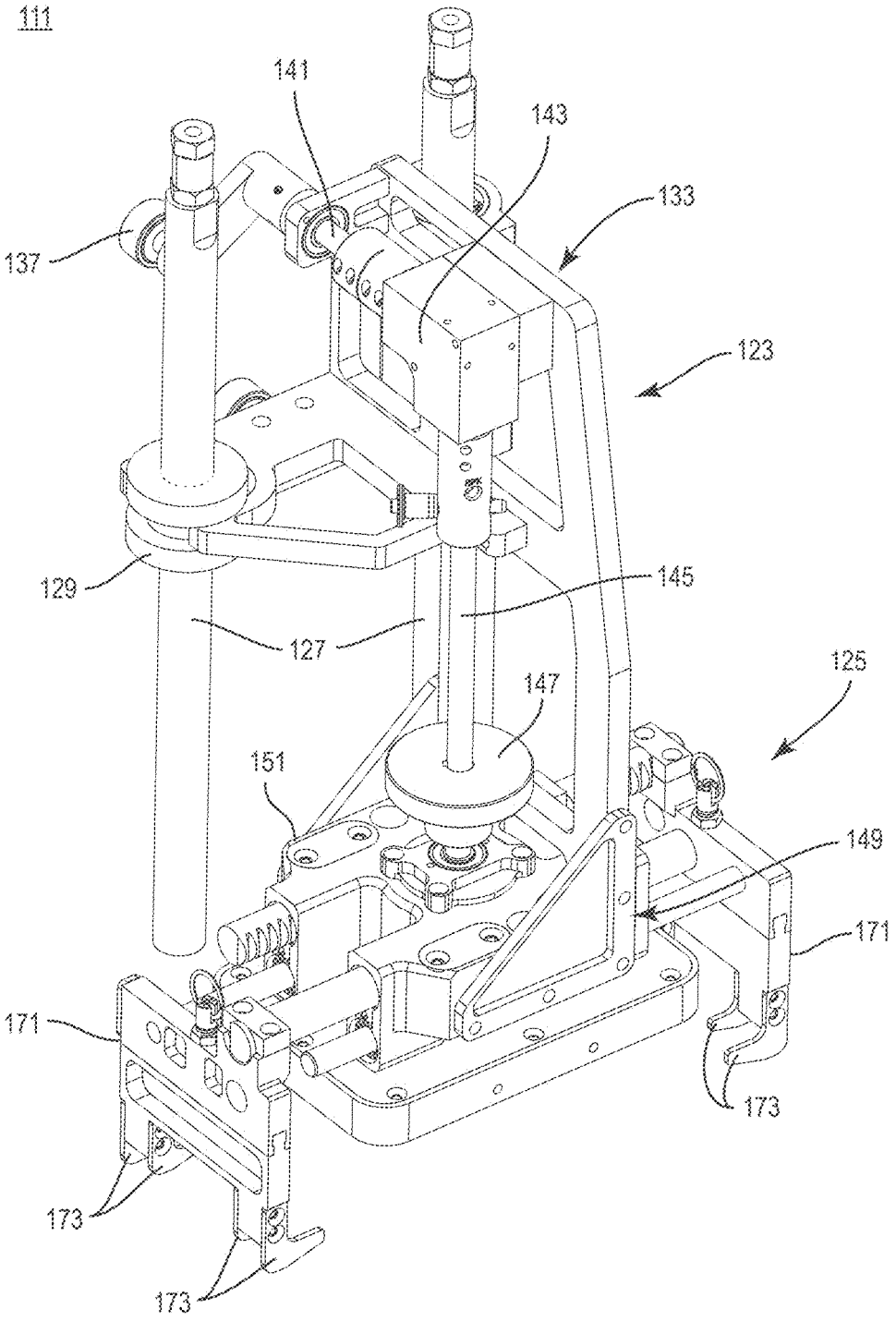
FIG. 6 is a perspective view of an end flap tucking apparatus of the product packaging system of FIG. 3.
Figure 7:
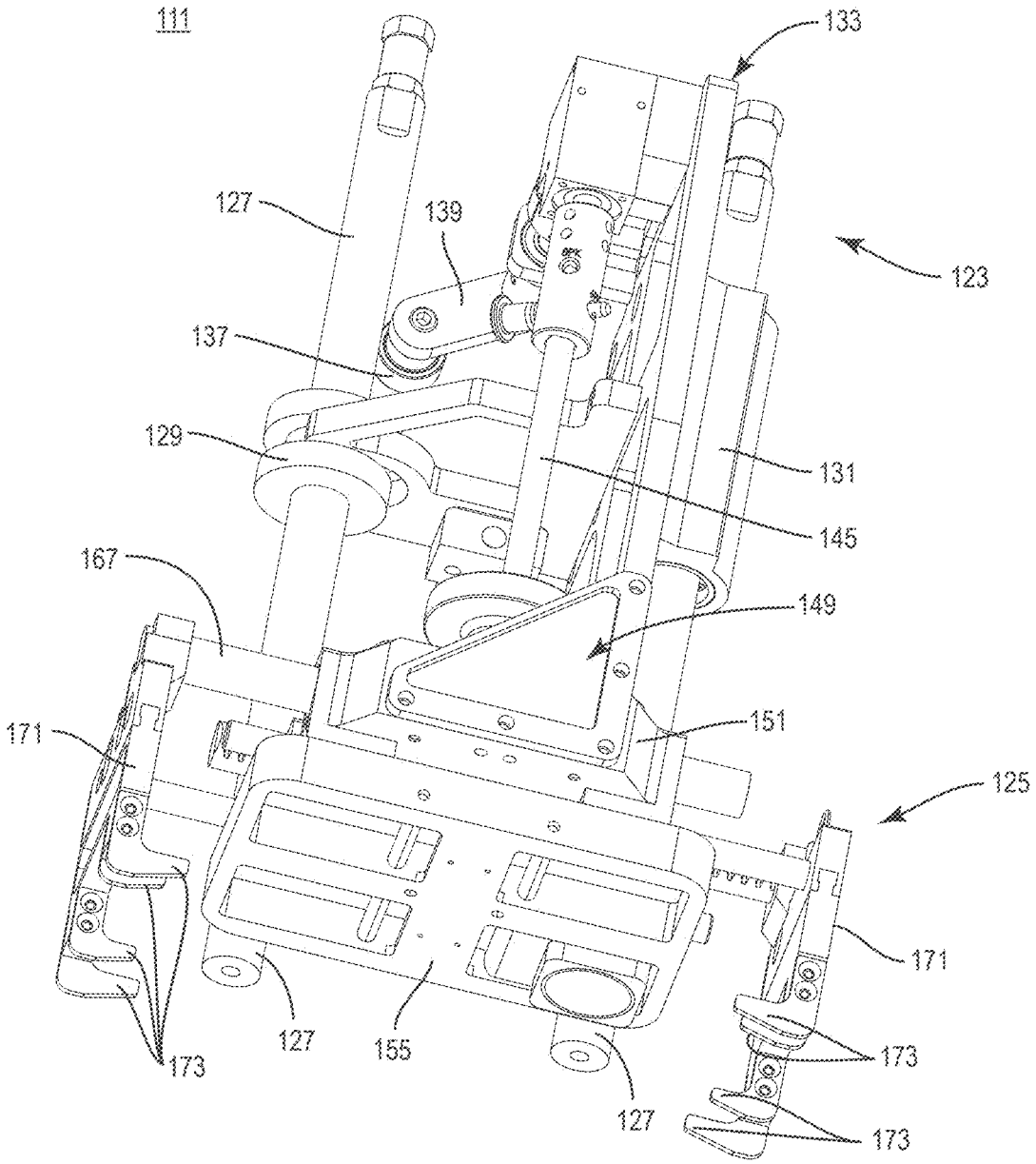
FIG. 7 is another perspective view of the end flap tucking apparatus of FIG. 6.
Figure 8:
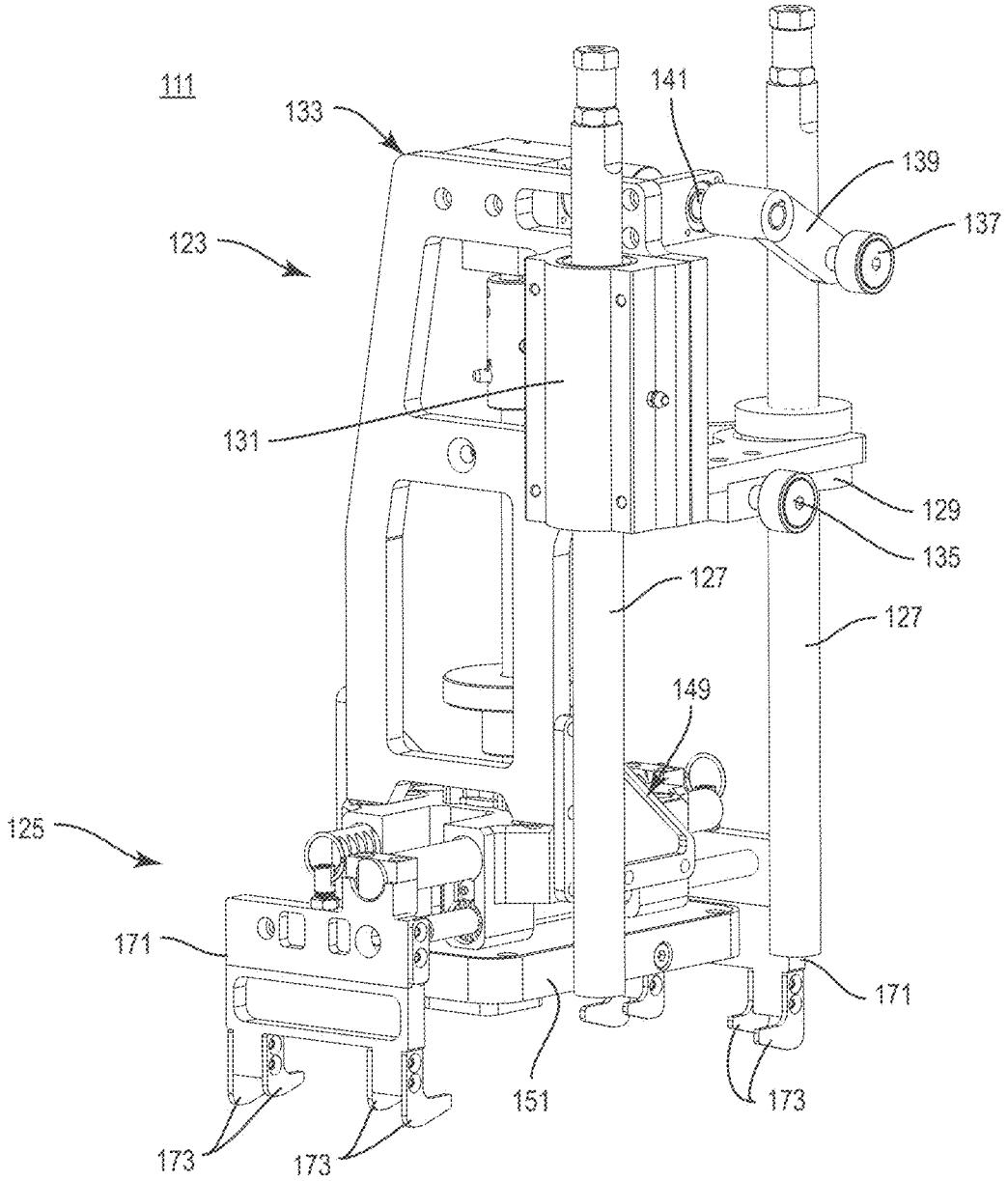
FIG. 8 is another perspective view of the end flap tucking apparatus of FIG. 6.
Figure 9:
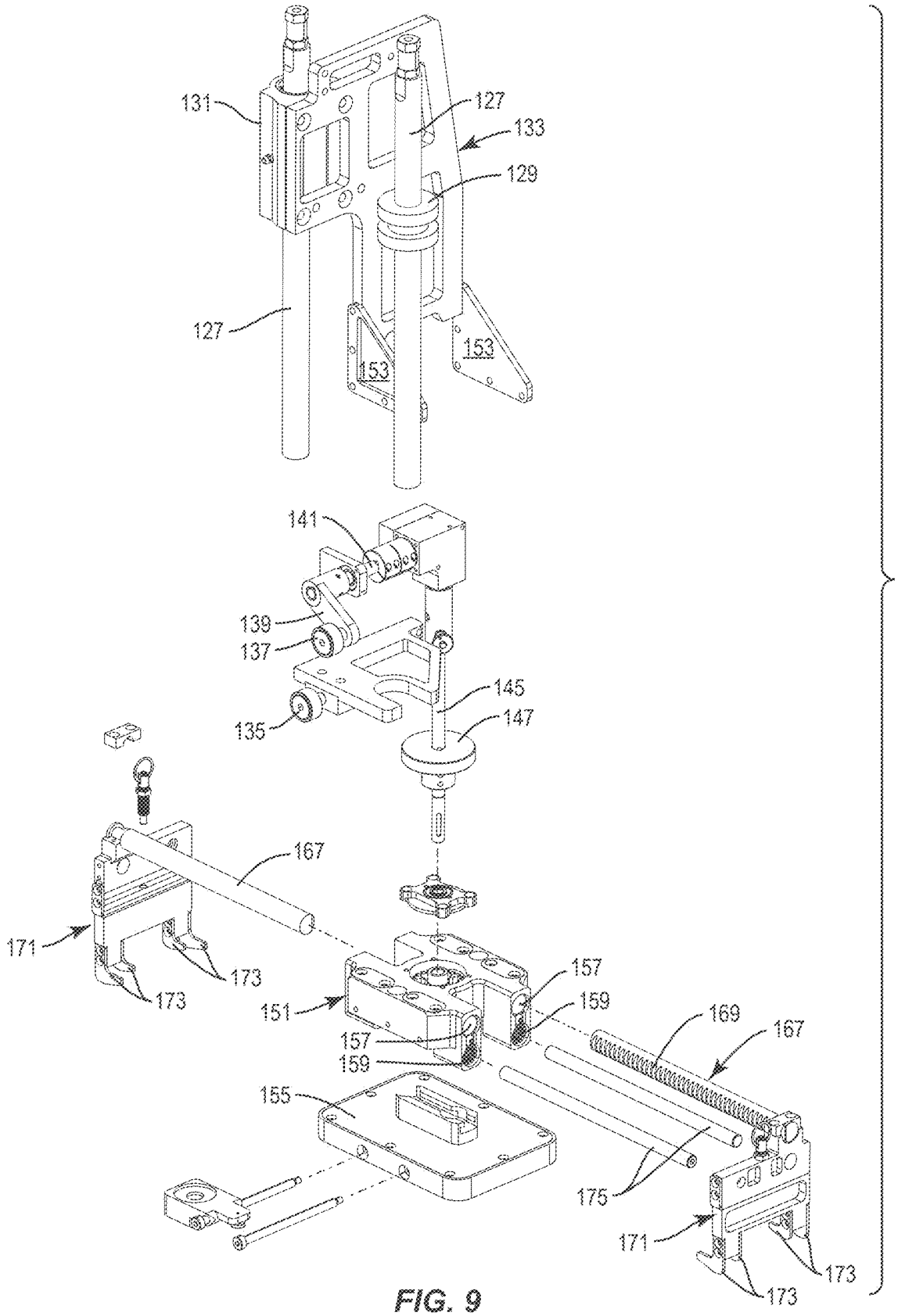
FIG. 9 is a perspective parts-separated view of the end flap tucking apparatus of FIG. 6.
Figure 10:
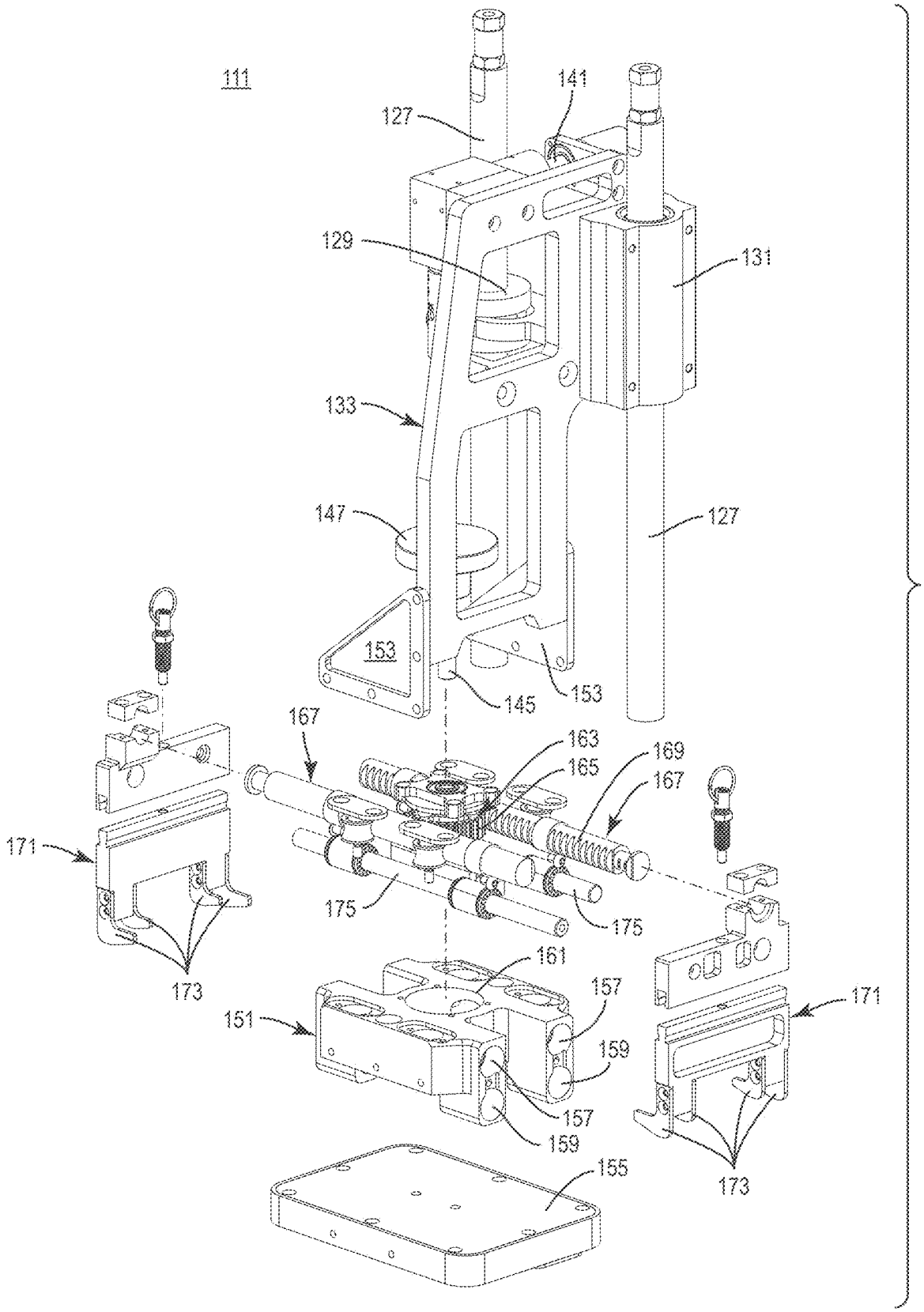
FIG. 10 is another perspective parts-separated view of the end flap tucking apparatus of FIG. 6.

With additional reference to FIGS. 3-5, a product packaging system 100 or portion thereof is illustrated according to an exemplary embodiment of the disclosure. As shown, the product packaging system 100 can include as least one end flap engagement assembly 103 for engaging one or more carriers 11 therealong. As described herein, the at least one end flap engagement assembly 103 can be a portion of the system 100 for at least partially moving one or more products in a downstream or machine direction M1 that at least partially extends away from an upstream portion or upstream end 105 of the system 100 toward a downstream portion or downstream end 107 of the system 100. An upstream or machine direction M2 can extend in a direction opposite the direction M1.

In this regard, the end flap engagement assembly 103 can include or can be positioned over a product conveyor configured to move one or more of the carriers 11 in the machine direction M1, for example, from an upstream station or component of the system 100. In the illustrated embodiment, the upstream station of component of the system 100 can be one or more of a product grouping assembly, a blank folding assembly, an assembly for at least partially attaching blanks/carriers to products, etc., and it will be understood that one or more intermediate stations or components can be provided without departing from the disclosure.

Furthermore, the end flap engagement assembly 103 or a product conveyor running therebelow can be configured to move the one or more blanks/constructs in the machine direction M1 toward a downstream station or component of the system 100, for example, one or more of blank processing assemblies (such as folding assemblies, gluing assemblies), product loading assemblies, product grouping assemblies, product metering assemblies, construct and/or product wrapping stations, turner and/or divider stations, etc. In some embodiments, a downstream end of the system 100 can be at least partially defined by a portion of the end flap engagement assembly 103.

The system 100 can include a machine frame 109 supporting at least the end flap engagement assembly 103, as well as various components thereof described herein. The frame 109 can include one or more of bases, legs, struts, tie bars, platforms, etc., in various arrangements, to provide a supporting structure for the assemblies and components described herein. For example, the machine frame 109 can support such components above a base surface such as a ground or floor, and can provide access at one or more locations for human operators, e.g., to inspect, maintain, and/or otherwise operate the system 100. In some embodiments, the system 100 can be provided with a different frame configuration.

In some embodiments, the frame 109 can include one or more adjustable components, e.g., including one or more actuators, relatively movable portions (e.g., telescoping portions, changeable/modular portions, portions configured for relative translation/extension/retraction, etc.) such that a height and or width of one or more portions of the frame 109, and components of the system 100 supported thereon, can be selectively movable.

With continued reference to FIGS. 3-5, the end flap engagement assembly 103 can include an end flap tucking apparatus 111 movably supported on a drive apparatus 113 and actuatable to engage respective portions of the product carrier 11 via interaction with a cam track apparatus 115.

As shown, the drive apparatus 113 can include a vertically-spaced pair of looped chains 117 that extend around respective pairs of sprockets 119 that are rotatably supported on the machine frame 109. Respective vertically aligned sprockets 119 can be mechanically coupled e.g., by an axle or other transmission, such that at least one sprocket 119 can be rotatably driven to cause rotation of the other sprockets 119. For example, the rotation of the vertically uppermost sprocket 119 proximate the upstream end 105 of the system 100 can cause concomitant rotation of one or more downstream sprockets 119 about which the respective chain 117 extends to drive rotation thereof. Furthermore, the vertically upper sprockets 119 can rotatably drive the vertically lower sprockets 119 to which they are mechanically coupled by the respective axle or other transmission, which can be coordinated with the respective chain 117 extending at least partially therearound.

In the illustrated embodiment, one or more of the sprockets 119 can be rotationally driven by one or more prime movers such as engines, motors, pneumatic or hydraulic systems, other actuators. In the illustrated embodiment, the vertically uppermost sprocket 119 can be rotatably driven by a motor 121. It will be understood that one or more components of the drive apparatus 113 can have a different configuration without departing from the disclosure.

With additional reference to FIGS. 6-10, the end flap tucking apparatus 111, as shown, can include an upper portion 123 configured to engage the cam track apparatus 115 and a lower portion 125 in mechanical cooperation with the upper portion 123 for at least partially engaging the product carrier 11. As described herein, the lower portion 125 of the end flap tucking apparatus 111 can be configured for movement relative to the upper portion 123 thereof, e.g. slidable movement.

Accordingly, and as shown, the upper portion 123 of the end flap tucking apparatus 111 can include a pair of vertical rails 127 along which the lower portion 125 of the end flap tucking apparatus 111 are slidably disposed. Furthermore, respective end portions of the vertical rails 127 can be mechanically coupled to the respective chains 117 such that, upon rotation of the respective chains 117 as described further herein, the end flap tucking apparatus 111 can be carried at least partially in the machine direction M1 with the respective chains 117.

A first bushing 129 can be slidably disposed along one of the vertical rails 127, and a second bushing 131 can be slidably disposed along the other of the vertical rails 127. Each of the bushings 129, 131 can thus have a tubular or collar-like configuration for slidably receiving a portion of the respective rail 127 therethrough. In some embodiments, one or more intermediate materials, e.g., coatings, sleeves, etc., can be positioned between an inner surface of the respective bushing 129, 131 and the respective rail 127 to facilitate relative and/or controlled movement thereof.

An upper frame 133 can mechanically couple the first bushing 129 to the second bushing 131, and the second bushing 131 to the lower portion 125 of the end flap tucking apparatus 111. It will be understood that the upper frame 133 can be a generally rigid structure suitable for transmitting applied forces thereacross to mechanically connected components of the system 100. In some embodiments, the upper frame 133 can be a unitary or monolithically formed member. In some embodiments, the upper frame 133 can be formed from multiple interconnected portions.

A first cam follower 135, e.g., a roller or disc-like member, can be coupled to the upper frame 133 so as to extend outwardly therefrom. As described further herein, the first cam follower 135 is configured to be at least partially received by the cam track apparatus 115 such that movement of the cam follower 135 in a vertical direction, e.g., generally transverse to the machine direction M1, can cause the upper frame 133 to which it is coupled to raise or lower vertically via slidable engagement of the bushings 129, 131 with the respective rails 127.

In this regard, the first cam follower 135 can be rotatably mounted to the frame 133 for rolling contact with the cam track apparatus 115 and/or can be provided with a coating or covering suitable for slidable movement therealong.

A second cam follower 137, as shown, can have a configuration generally similar to the first cam follower 135 and can be mounted on an arm 139 that is rotatably, e.g., pivotably, coupled to an input shaft 141 that extends generally outwardly from the cam track apparatus 115, e.g., past the rails 127. In some embodiments, the shaft 141 can extend along a direction generally transverse to the direction M1.

The shaft 141, as shown, can be in mechanical cooperation with a gearbox 143 that can be configured to transfer rotational forces input by the shaft 141 under the influence of the cam follower 135 to rotational forces along an output shaft 145 that extends downwardly toward the lower portion 125 of the end flap tucking apparatus 111.

In this regard, the gearbox 143 can be a form of right angle transmission that converts an input rotational force, e.g., from the shaft 141, to an output rotational force, e.g., to the shaft 145. Accordingly, the gearbox 143 can include an arrangement of gears, e.g., spur gears, worm gears, bevel gears, planetary gears, etc., configured to effect such input and output rotational motion. In some embodiments, the gearbox 143 can be configured for gear reduction of such forces, e.g., by transmitting the input rotational force from the shaft 141 along differently-sized gears so as to adjust the output speed or torque applied to the shaft 145 thereby.

The output shaft 145 of the gearbox 143 can be coupled to a rotational coupling 147 that is configured for rotation therewith to apply rotational forces carried by the output shaft 145 of the gearbox 143 to one or more portions of the lower portion 125 of the end flap tucking apparatus 111. In some embodiments, the rotational coupling 147 can be configured to alter one or more properties of the rotational force transmitted by the output shaft 145, e.g., speed, torque, etc. In some embodiments, the output shaft 145 can be configured to directly drive such one or more portions of the lower portion 125 of the end flap tucking apparatus 111.

The lower portion 125 of the end flap tucking apparatus 111, as shown, can include a lower frame 149 of the apparatus 111 that is coupled to the upper frame 133 of the apparatus 111 such that movement of the upper frame 133 carries therewith the lower frame 149 and components supported thereon.

The lower frame 149, as shown, can include a block body 151 and a pair of arms 153 that extend from the block body 151 to the upper frame 133.

In some embodiments, a base plate 155 can be coupled to the lower frame 149 of the apparatus 111, e.g., at the block body 151, and can be for being positioned over a portion of one or more carriers 11 during operation of the system 100/apparatus 111.

The block body 151, as shown, can include a respective pair of upper parallel channels 157 at least partially defined therein and extending therethrough, and a respective pair of lower parallel channels 159 at least partially defined therein and extending therethrough. In the illustrated embodiment, the upper channels 157 are generally aligned over the channels 159, each channel 157, 159 extending generally parallel to the machine direction M1, though it will be understood that one or more of the channels 157, 159 can have a different configuration without departing from the disclosure.

The block body 151 can also at least partially define therein a generally central recess 161 at least partially though an upper surface thereof, the recess 161 in at least partial communication with each of the channels 157.

As shown, the recess 161 in the block body 151 can be configured and dimensioned for at least partially receiving a spur gear 163 with a body defining teeth 165, e.g., a series of alternating recesses and protrusions, positioned for abutting and/or extending into a portion of each respective channel 157.

Each channel 157, as shown, can at least partially receive a respective adjustment rod 167 therethrough, each adjustment rod 167 slidably received therein and configured for being at least partially extended from the block body 151 and for being at least partially recessed in the block body 151, as described further herein.

The respective adjustment rods 167, as shown, can include respective bodies that at least partially define a series of teeth 169, e.g., alternating recesses and protrusions, for intermeshing with respective teeth 165 of the spur gear 163. The adjustment rods 167 are oriented in the respective channels 157 facing the recess 161 and the spur gear 163 at least partially received therein.

The spur gear 163 can be rotatably disposed, e.g., relative to the block body 151, in the recess 161 and coupled with the rotational coupling 147 such that rotation of the spur gear 163 can cause the adjustment rods 167 to be translated toward or away from the block body 151 when the end flap tucking apparatus 111 is in operation, as described further herein.

Each adjustment rod 167, as shown, is coupled to a respective mount 171 that extends generally downwardly therefrom. The respective mounts 171 can be generally plate-like members that support respective tucking fingers 173 coupled to a lower portion thereof, for example. As also shown, a respective support rod 175 can be coupled to each respective mount 171 and be slidably received in the respective lower channel 159 to facilitate relative movement of the mounts 171 relative to the block body 151, as described further herein.

The tucking fingers 173, as shown, can have a generally hook-shaped or otherwise curved arrangement and can be positioned at a lowermost portion of the end flap tucking apparatus 111 for engaging a respective end flap 21 of a respective product carrier 11, as described further herein.

Figure 11:
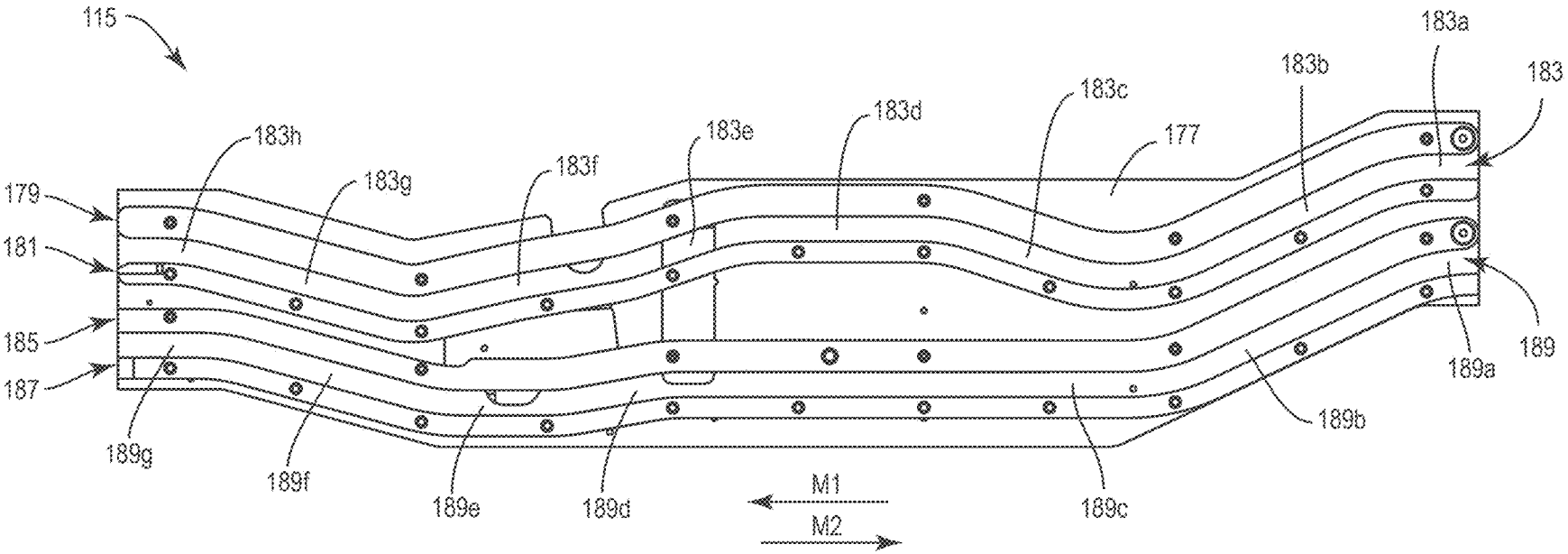
FIG. 11 is an elevation view of a cam track apparatus of the product packaging system of FIG. 3.
Figure 12:
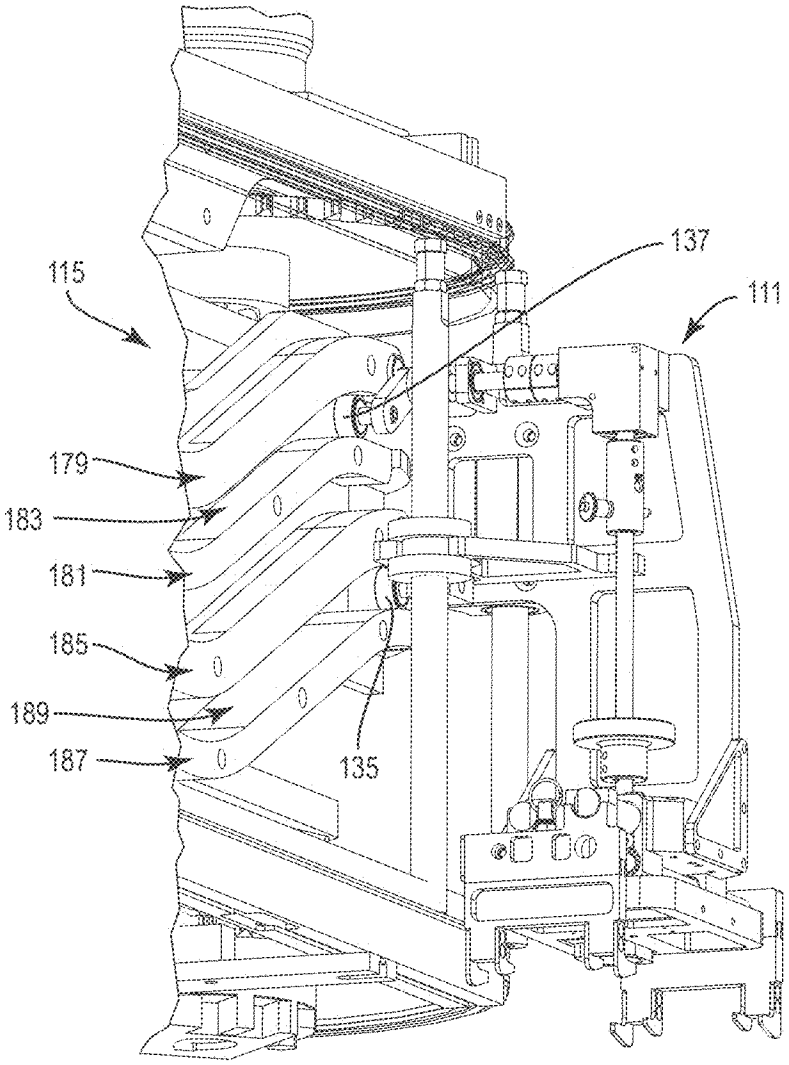
FIG. 12 is an enlarged perspective view of a portion of the product packaging system of FIG. 3 including the end flap tucking apparatus and the cam track apparatus.
Figure 13:
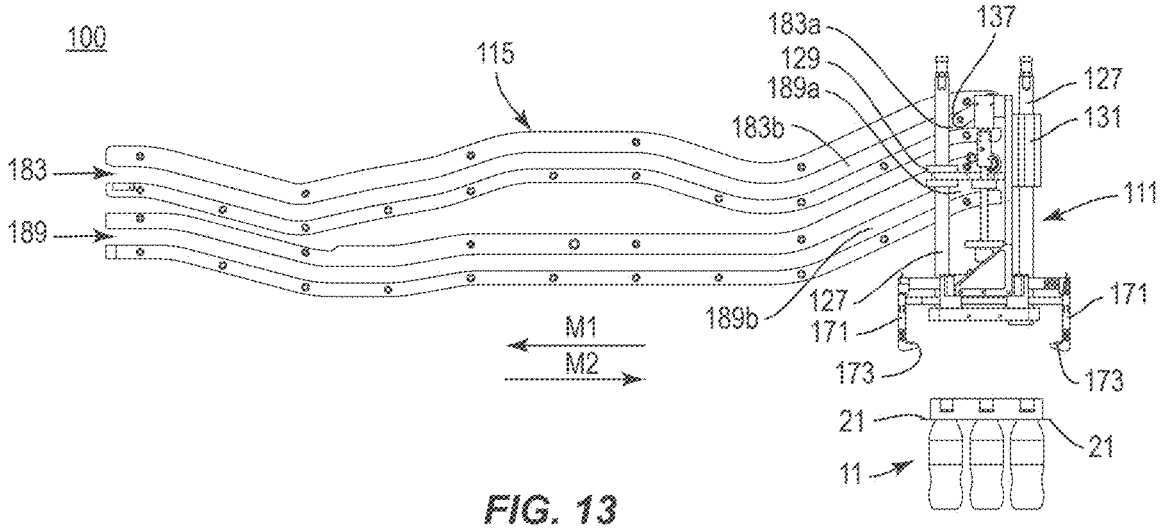
FIG. 13 is a first sequential elevation view showing an operation of the end flap tucking apparatus of the product packaging system of FIG. 3.
Figure 14:
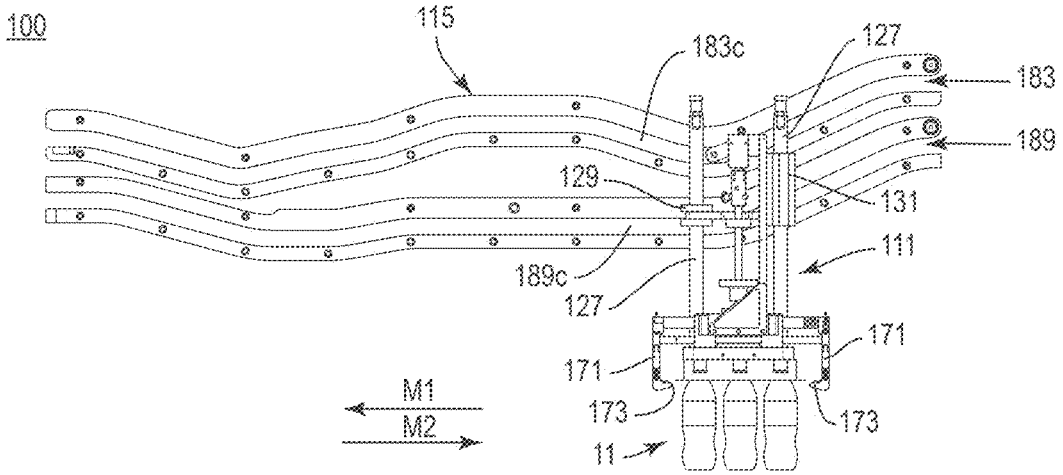
FIG. 14 is a second sequential elevation view showing an operation of the end flap tucking apparatus of the product packaging system of FIG. 3.
Figure 15:
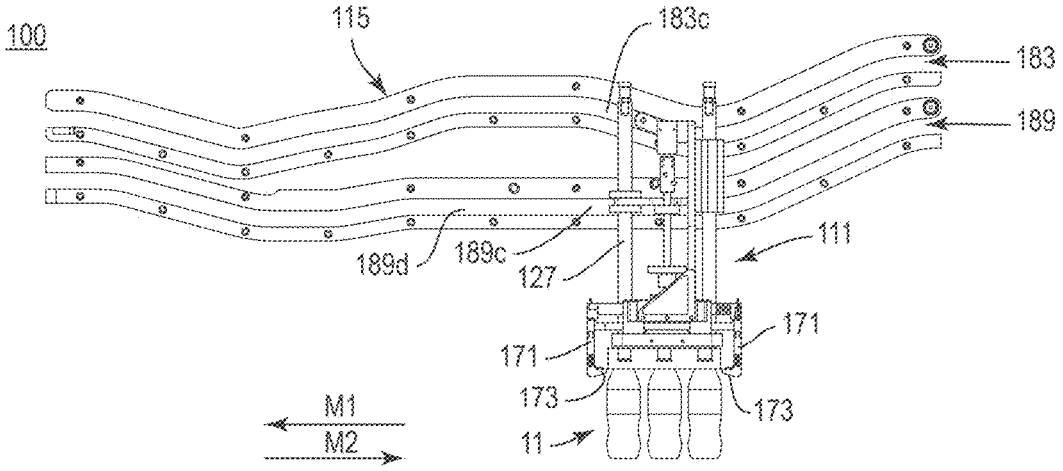
FIG. 15 is a third sequential elevation view showing an operation of the end flap tucking apparatus of the product packaging system of FIG. 3.
Figure 16:
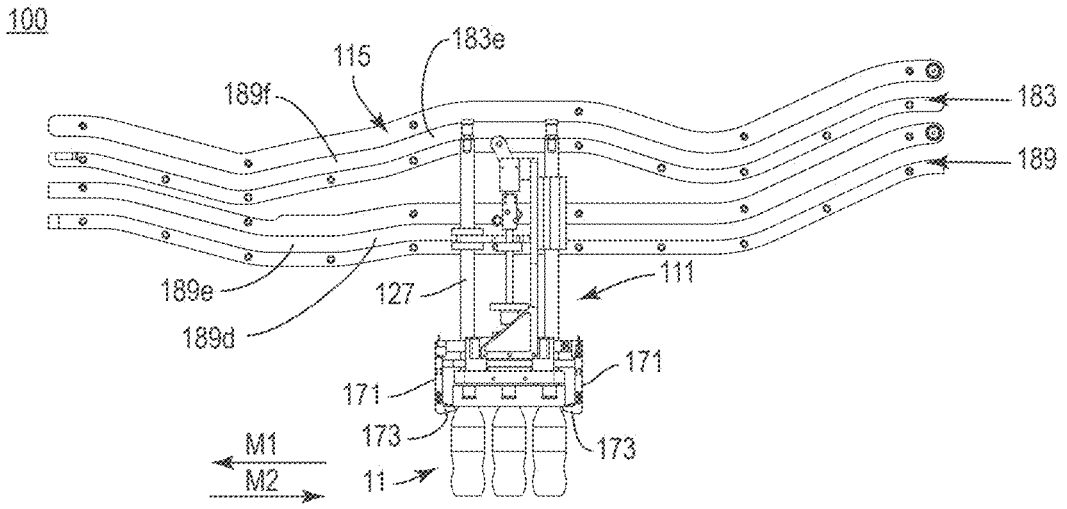
FIG. 16 is a fourth sequential elevation view showing an operation of the end flap tucking apparatus of the product packaging system of FIG. 3.
Figure 17:
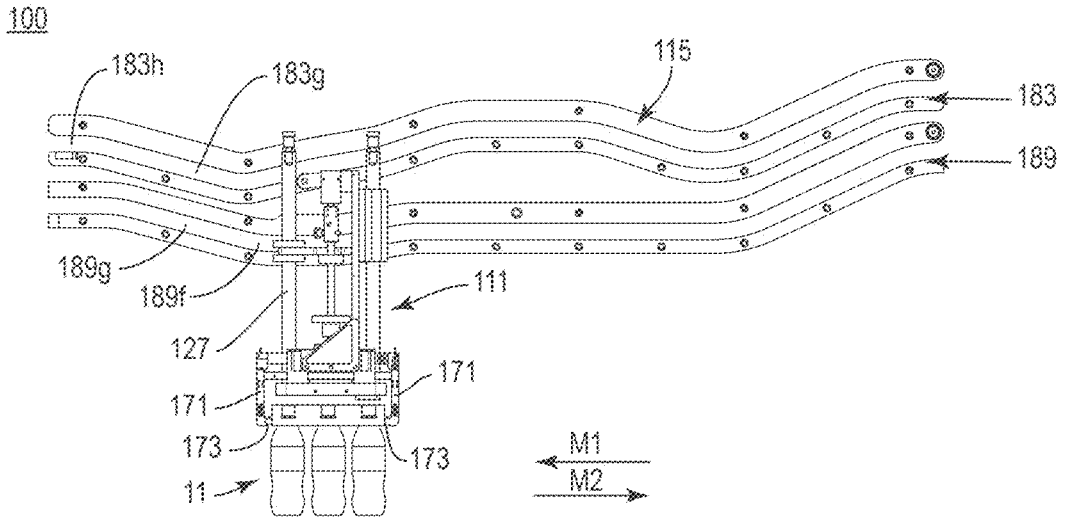
FIG. 17 is a fifth sequential elevation view showing an operation of the end flap tucking apparatus of the product packaging system of FIG. 3.
Figure 18:
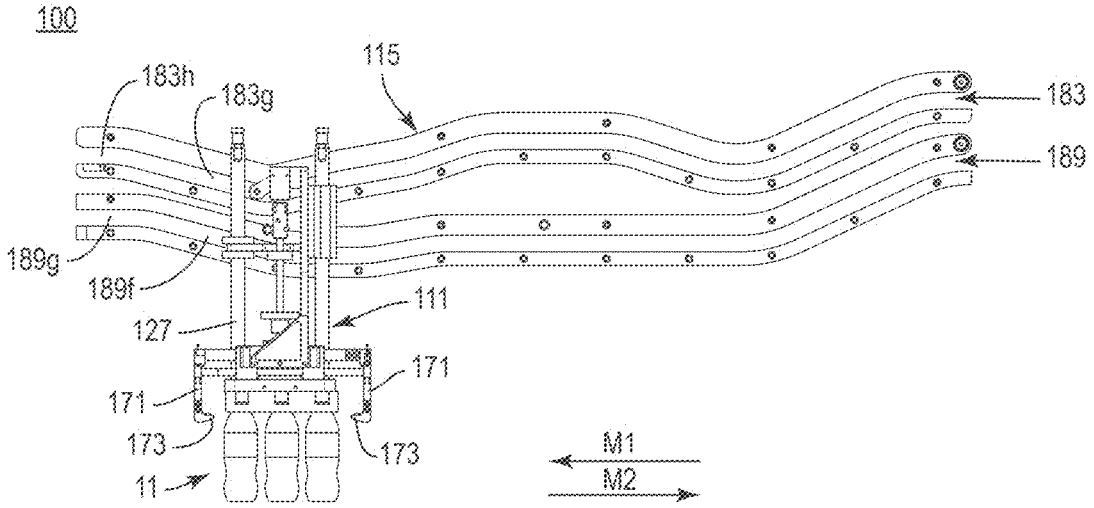
FIG. 18 is a sixth sequential elevation view showing an operation of the end flap tucking apparatus of the product packaging system of FIG. 3.
Figure 19:
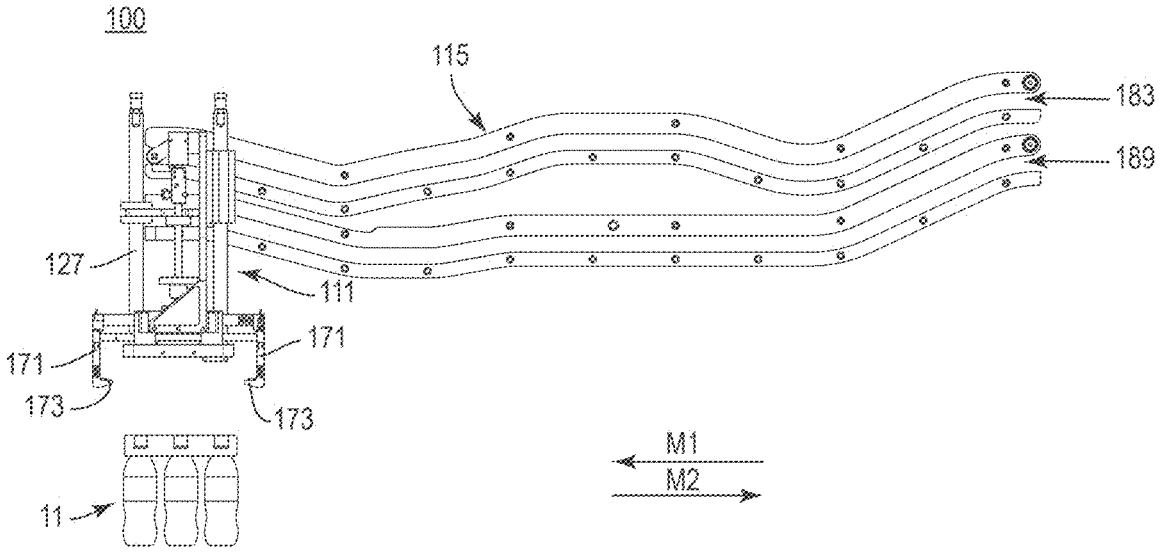
FIG. 19 is a seventh sequential elevation view showing an operation of the end flap tucking apparatus of the product packaging system of FIG. 3.

With continued reference to FIGS. 3-10, and with additional reference to FIGS. 11 and 12, the cam track assembly 115 of the end flap engagement assembly 103, as described above, can be configured to at least partially receive the respective cam followers 135, 137 for effecting articulation of one or more portions of the end flap tucking apparatus 111.

The cam track assembly 115, as shown, can include a front bedplate 177 supported on the machine frame 109 and supporting thereon a plurality of cam rails. In the illustrated embodiment, the cam rails of the cam track assembly 115 can include a pair of vertically spaced cam rails 179, 181 coupled to the bedplate 177 and at least partially defining an upper cam track 183 (broadly, "second cam track") therebetween for at least partially receiving the cam follower 137.

A pair of vertically spaced cam rails 185, 187 can also be attached to the bedplate 177 below the cam rails 179, 181 and can at least partially define therebetween a lower cam track 189 (broadly, "first cam track") for at least partially receiving the cam follower 135.

The cam rails 179, 181 can be bodies that protrude from the bedplate 177 and which have one or more of straight, oblique, and/or curved portions such that the upper cam track 183, in the machine direction M1, can have a first generally straight segment 183*a*, a first generally obliquely downwardly extending segment 183*b*, a first generally obliquely upwardly extending segment 183*c*, a second generally straight segment 183*d*, a second generally obliquely downwardly extending segment 183*e*, a third generally obliquely downwardly extending segment 183*f*, a second generally obliquely upwardly extending segment 183*g*, and a third generally straight segment 183*h*.

Similarly, the cam rails 185, 187 can be bodies that protrude from the bedplate 177 and which have one or more of straight, oblique, and/or curved portions such that the lower cam track 189, in the machine direction M1, can have a first generally straight segment 189*a*, a first generally obliquely downwardly extending segment 189*b*, a second generally straight segment 189*c*, a second generally obliquely downwardly extending segment 189*d*, a third generally straight segment 189*e*, a generally obliquely upwardly extending segment 189*f*, and a fourth generally straight segment 189*g*.

It will be understood that respective adjacent segments of the respective cam tracks 183, 189 described above can transition to one another, for example, at a respective curving portion of the respective cam tracks 183, 189, though different transitions can be provided between adjacent segments without departing from the disclosure. It will be understood that a different arrangement of cam rails and/or cam tracks at least partially defined thereby can be provided without departing from the disclosure.

As shown in FIGS. 3-5, each cam track 183, 189 exits to an upper surface of a respective return rail 191, 193 that curves from an abutting and/or overlapping engagement with the respective cam rail 179, 181, 185, 187, around a back side of the cam track assembly 115 and across a bedplate 195 opposite the bedplate 177, and which curve again into an abutting and/or overlapping engagement with the respective cam rails 179, 181 and cam rails 185, 187 in communication with an entry into the respective cam tracks 183, 189. The return rails 191, 193 can be supported on the bedplate 195.

With additional reference to FIGS. 13-19, one or more operations of the system 100 with regard to a product carrier 11 will be described according to exemplary embodiments of the disclosure.

One or more carriers 11 can be provided in a product path extending generally along the machine direction M1. The carriers 11 can be supported on one or more product conveyors, e.g., belts, chains, bedplates, etc., which can optionally cooperate with one or more lugs, flights, etc. extending therealong for engaging a respective product carrier 11.

The carriers 11 can be in an at least partially formed or intermediately-formed configuration thereof in which one or more of the respective end flaps 21 are positioned extending away from the respective interior recesses 17, 19 prior to engagement with the end flap engagement assembly 103, as described further below.

As the carriers 11 approach a vertical alignment with the end flap trucking apparatus 111 at an upstream portion of the end flap engagement assembly 103, e.g., proximate the segments 183*a*, 189*a* of the cam tracks 183, 189, the motor 121 can be activated to rotate a respective sprocket 119.

Rotation of the sprocket 119 associated with the motor 121 can cause the sprocket 119 about which the respective chain 117 extends toward and around to rotate in kind via engagement with the chain 117. Furthermore, the upper sprockets 119, via mechanical connection via respective axels or other transmissions, can cause the respective lower sprockets 119 and the chain 117 disposed thereabout to rotate.

As the chains 117 rotate, e.g., clockwise from the perspective viewed in FIG. 3, the vertical rails 127 of the end flap tucking apparatus 111 can be carried in the machine direction M1. In this regard, the cam followers 135, 137 extending at least partially into the respective cam tracks 189, 183 can move under the guidance of the cam rails 179, 181 and cam rails 185, 187 to effect articulation of the end flap tucking apparatus 111.

For example, as the cam follower 135 moves along the cam track 189, vertically upwardly extending segments of the cam track 189 can cause the cam follower 135 to slide and/or roll along the portions of the adjacent cam rails 185, 187 to urge the upper frame 133 of the end flap tucking apparatus 111 upwardly, which is accomplished via slidable movement of the bushings 129, 131 along the respective rails 127.

Similarly, as the cam follower 135 moves along the cam track 189, vertically downwardly extending segments of the cam track 189 can cause the cam follower 135 to slide and/or roll along the portions of the adjacent cam rails 185, 187 to urge the upper frame 133 of the end flap tucking apparatus 111 downwardly via slidable movement of the bushings 129, 131 along the respective rails 127.

The lower portion 125 of the end flap tucking apparatus 111 attached to the upper frame 133 can thus be carried upwardly or downwardly to effect vertical adjustment thereof based on a vertical profile of the cam track 189.

Furthermore, as the cam follower 137 moves along the cam track 183, vertically upwardly extending segments of the cam track 183 can cause the cam follower 135 to slide and/or roll along the portions of the adjacent cam rails 179, 181 to move the arm 139 to rotate the input shaft 141 into the gearbox 143 and cause subsequent rotation of the output shaft 145.

Such rotation of the output shaft 145 can cause counterclockwise rotation of the rotational coupling 147 and spur gear 163 within the recess of the block body 151 of the lower portion 125 of the end flap tucking apparatus 111 (from the perspective of FIG. 3). Such rotation of the spur gear 163 can be such that the teeth 165 defined along the outer circumference therealong, and which are positioned to intermesh with the respective teeth 169 of the respective adjustment rods 167 in the respective channels 157 in the block body 151, can cause the respective adjustment rods 167 to retract inwardly into the respective channels 157 to carry the respective mounts 171 and tucking fingers 173 supported thereon toward the block body 151.

Accordingly, the respective mounts 171 and fingers 173 supported thereon can be caused to move together along the respective machine directions M1, M2 relative to the remainder of the end flap tucking apparatus 111 based on a vertical profile of the cam track 183. It will be understood that the concomitant movement of the support rods 175 through the respective lower channels 159 can facilitate such movement of the mounts 171 and fingers 173.

Similarly, as the cam follower 137 moves along the cam track 183, vertically downwardly extending segments of the cam track 183 can also cause the cam follower 137 to slide and/or roll along the portions of the adjacent cam rails 179, 181 to move the arm 139 to rotate the input shaft 141 into the gearbox 143 and cause subsequent rotation of the output shaft 145.

Such rotation of the output shaft 145 can cause clockwise rotation of the rotational coupling 147 and spur gear 163 within the recess of the block body 151 of the lower portion 125 of the end flap tucking apparatus 111 (from the perspective of FIG. 3). Such rotation of the spur gear 163 can be such that the teeth 165 of the spur gear 163 that are intermeshed with the teeth 169 of the adjustment rods 167 cause the respective adjustment rods 167 to extend outwardly from the respective channels 157 to carry the respective mounts 171 and tucking fingers 173 supported thereon away from the block body 151 and away from each other. It will be understood that the concomitant movement of the support rods 175 through the respective lower channels 159 can facilitate such movement of the mounts 171 and fingers 173.

In this regard, a distance between the fingers 173 of the end flap tucking apparatus along the machine directions M1, M2 can thus be adjusted via engagement of the cam followers 135, 137 of the end flap tucking apparatus 111 with the cam track assembly 115.

In view of the foregoing, and with reference to the schematic sequential views of FIGS. 13-19, the cam followers 135, 137 can enter the respective cam tracks 183, 189 at the respective segments 183*a*, 189*a* thereof such that the respective pairs of tucking fingers 173 are held above a product carrier 11 therebelow and spaced apart a distance along the machine directions M1, M2 at or greater than a position of the respective opposed end flaps 21.

As the cam followers 135, 137 travel along the respective segments of the cam tracks 189, 183, e.g., segments 189*b*, 183*a*, the respective pairs of tucking fingers 173 are vertically lowered toward a general alignment with the respective top end flaps 21 and are at least partially maintained or extended outwardly toward a distance sufficient to engage the respective end flaps 21. In some embodiments, the respective pairs of tucking fingers 173 can be lowered at least partially downwardly below the respective top end flaps 173.

Further movement of the cam followers 135, 137 along the respective segments of the cam tracks 189, 183, e.g., segments 189*b*, 183*b*, 189*c*, 183*c*, 189*d*, 183*d*, 189*e*, 183*e*, 183*f* causes the respective pairs of tucking fingers 173 to draw closer together, e.g., in opposed directions along the machine directions M1, M2, to urge/fold the end flaps 21 into the respective interior recesses 17, 19 of the product carrier 11. In some embodiments, such action of the tucking fingers 173 can urge the end flaps 21 to move into a generally bracing engagement with a respective container B positioned extending to an underside of a respective flange F of a respective container B. It will be understood that the relative paths of the segments 189*b*, 183*b*, 189*c*, 183*c*, 189*d*, 183*d*, 189*e*, 183*e*, 183*f* can include vertical adjustments that serve as fine control for the respective tucking fingers 173 to tuck the respective end flaps 21 into the respective interior recesses 17, 19 of the product carrier 11, e.g., so as to avoid edges, bunching, etc.

As the cam followers 135, 137 continue along the respective segments of the cam tracks 189, 183, e.g., segments 189*f*, 189*g*, 183*g*, 183*h*, the respective pairs of tucking fingers 173 are extended outwardly apart, e.g., away from the respective interior recesses 17, 19 of the product carrier 11, and can be raised upwardly and away from the product carrier 11. Such movement of the respective pairs of tucking fingers 173 into a further spaced apart relationship prior to and/or simultaneously with the vertical movement upwardly away from the product carrier 11 can, in some embodiments, avoid incidental contact with one or more edges or surfaces of the product carrier 11.

Thereafter, the respective cam followers 135, 137 can exit each cam track 189, 183 an upper surface of a respective return rail 191, 193 and slidably and/or rollably engage the respective surfaces of the return rails 191, 193 so as to follow a return path at least partially defined thereby to facilitate re-entry into the respective cam tracks 183, 189 at an upstream end 105 of the system 100 to engage a subsequent product carrier 11 along the product path moving therebelow.

In this regard, the arrangement of the cam track apparatus 115 is such that the tucking fingers 173 of the end flap tucking apparatus 111 can be carried into a controlled and precise movement for engaging and tucking respective end flaps 21 into respective interior recesses 17, 19 of the product carrier 11 and/or an engagement with a respective portion of a container B held therein while otherwise minimizing, inhibiting, and/or avoiding incidental contact with respective portions of the carrier(s) 11 so as to streamline forming operations.

It will be understood that one or more components of the system 100 can have a different configuration, position, arrangement, etc., without departing from the disclosure.

In general, the blanks/constructs according to the present disclosure may be constructed from paperboard having a caliper so that it is heavier and more rigid than ordinary paper. The blank can also be constructed of other materials, such as cardboard, or any other material having properties suitable for enabling the construct to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A method of engaging at least one end flap of a carrier, the method comprising:

moving the carrier below an end flap engagement assembly along a product path parallel to a machine direction of the end flap engagement assembly;

activating a drive apparatus to cause an end flap tucking apparatus to move in the machine direction;

engaging a first cam follower of the end flap tucking apparatus with a first cam track to cause vertical movement of at least one tucking finger of the end flap tucking apparatus relative to the carrier;

engaging a second cam follower of the end flap tucking apparatus with a second cam track to cause movement of the at least one tucking finger of the end flap tucking apparatus along the machine direction relative to a remainder of the end flap tucking apparatus; and contacting and moving the at least one end flap of the carrier with the at least one tucking finger of the end flap tucking apparatus.

2. The method of claim 1, wherein the second cam track comprises at least one upwardly-extending segment and at least one downwardly-extending segment, and the method comprises moving the second cam follower along the at least one upwardly-extending segment of the second cam track to cause the at least one tucking finger of the end flap tucking apparatus to move along the machine direction toward the carrier.

3. The method of claim 2, wherein the method comprises moving the second cam follower along the at least one downwardly-extending segment of the second cam track to cause the at least one tucking finger of the end flap tucking apparatus to move along the machine direction away from the carrier.

4. The method of claim 3, wherein the first cam track comprises at least one upwardly-extending segment and at least one downwardly-extending segment, and the method comprises moving the first cam follower along the at least one downwardly-extending segment of the first cam track to move at least one tucking finger downwardly relative to the carrier.

5. The method of claim 4, wherein the method comprises moving the first cam follower along the at least one upwardly-extending segment of the first cam track to move the at least one tucking finger upwardly relative to the carrier.

6. The method of claim 5, wherein the end flap tucking apparatus is coupled to the drive apparatus with a plurality of rails, and movement of the first cam follower along the at least one downwardly-extending segment causes a portion of the end flap tucking apparatus supporting the at least one tucking finger to slide downwardly along the plurality of rails.

7. The method of claim 6, wherein movement of the first cam follower along the at least one upwardly-extending segment causes a portion of the end flap tucking apparatus supporting the at least one tucking finger to slide upwardly along the plurality of rails.

8. The method of claim 7, wherein the second cam follower is operably coupled to a gearbox, the gearbox in mechanical communication with a gear intermeshed with at least a portion of at least one adjustment rod supporting the at least one tucking finger such that movement of the second cam follower along the at least one downwardly-extending segment of the second cam track causes the at least one adjustment rod to move away from the carrier.

9. The method of claim 8, wherein movement of the second cam follower along the at least one upwardly-extending segment of the second cam track causes the at least one adjustment rod to move along the machine direction toward the carrier.

10. A product packaging system, comprising:

an upstream end;

a downstream end, a machine direction extending from the upstream end to the downstream end;

a machine frame;

an end flap engagement assembly supported on the machine frame, the end flap engagement assembly comprising:

a drive apparatus;

an end flap tucking apparatus movably supported on the drive apparatus, the end flap tucking apparatus comprising a first cam follower, a second cam follower, and at least one tucking finger for contacting and moving at least one end flap of a carrier;

a first cam track at least partially receiving the first cam follower such that movement of the first cam follower along the first cam track is arranged to cause vertical movement of the at least one tucking finger of the end flap tucking apparatus relative to the carrier; and a second cam track at least partially receiving the second cam follower such that movement of the second cam follower along the second cam track is arranged to cause movement of the at least one tucking finger of the end flap tucking apparatus along the machine direction relative to a remainder of the end flap tucking apparatus.

11. The product packaging system of claim 10, wherein the second cam track comprises at least one upwardly-extending segment such that the second cam follower is arranged to move along the at least one upwardly-extending segment of the second cam track to cause the at least one tucking finger of the end flap tucking apparatus to move along the machine direction toward the carrier.

12. The product packaging system of claim 11, wherein the second cam track comprises at least one downwardly-extending segment such that the second cam follower is arranged to move along the at least one downwardly-extending segment of the second cam track to cause the at least one tucking finger of the end flap tucking apparatus to move along the machine direction away from the carrier.

13. The product packaging system of claim 12, wherein the first cam track comprises at least one downwardly-extending segment such that the first cam follower is arranged to move along the at least one downwardly-extending segment of the first cam track to move at least one tucking finger downwardly relative to the carrier.

14. The product packaging system of claim 13, wherein the first cam track comprises at least one upwardly-extending segment such that the first cam follower is arranged to move along the at least one upwardly-extending segment of the first cam track to move at least one tucking finger upwardly relative to the carrier.

15. The product packaging system of claim 14, wherein the end flap tucking apparatus is slidably coupled to the drive apparatus with a plurality of rails such the first cam follower is arranged to move along the at least one downwardly-extending segment to cause a portion of the end flap tucking apparatus supporting the at least one tucking finger to slide downwardly along the plurality of rails, and such that the first cam follower is arranged to move along the at least one upwardly-extending segment to cause a portion of the end flap tucking apparatus supporting the at least one tucking finger to slide upwardly along the plurality of rails.

16. The product packaging system of claim 15, wherein the second cam follower is operably coupled to a gearbox, the gearbox in mechanical communication with a gear intermeshed with at least a portion of at least one adjustment rod supporting the at least one tucking finger such that the second cam follower is arranged to move along the at least one downwardly-extending segment of the second cam track to cause the at least one adjustment rod to move away from the carrier, and such that the second cam follower is arranged to move along the at least one upwardly-extending segment of the second cam track to cause the at least one adjustment rod to move along the machine direction toward the carrier.

17. An end flap engagement assembly for engaging a carrier, comprising:

an end flap tucking apparatus comprising a first cam follower, a second cam follower, and at least one tucking finger for contacting and moving at least one end flap of the carrier;

a first cam track at least partially receiving the first cam follower such that movement of the first cam follower along the first cam track is arranged to cause vertical movement of the at least one tucking finger of the end flap tucking apparatus relative to the carrier; and a second cam track at least partially receiving the second cam follower such that movement of the second cam follower along the second cam track is arranged to cause movement of the at least one tucking finger of the end flap tucking apparatus along a machine direction relative to a remainder of the end flap tucking apparatus.

18. The end flap engagement assembly of claim 17, wherein the second cam track comprises at least one upwardly-extending segment such that the second cam follower is arranged to move along the at least one upwardly-extending segment of the second cam track to cause the at least one tucking finger of the end flap tucking apparatus to move along the machine direction toward the carrier.

19. The end flap engagement assembly of claim 18, wherein the second cam track comprises at least one downwardly-extending segment such that the second cam follower is arranged to move along the at least one downwardly-extending segment of the second cam track to cause the at least one tucking finger of the end flap tucking apparatus to move along the machine direction away from the carrier.

20. The end flap engagement assembly of claim 19, wherein the first cam track comprises at least one downwardly-extending segment such that the first cam follower is arranged to move along the at least one downwardly-extending segment of the first cam track to move the at least one tucking finger downwardly relative to the carrier.

21. The end flap engagement assembly of claim 20, wherein the first cam track comprises at least one upwardly-extending segment such that the first cam follower is arranged to move along the at least one upwardly-extending segment of the first cam track to move the at least one tucking finger upwardly relative to the carrier.

22. The end flap engagement assembly of claim 21, wherein the end flap tucking apparatus comprises a plurality of rails such the first cam follower is arranged to move along the at least one downwardly-extending segment to cause a portion of the end flap tucking apparatus supporting the at least one tucking finger to slide downwardly along the plurality of rails, and such that the first cam follower is arranged to move along the at least one upwardly-extending segment to cause a portion of the end flap tucking apparatus supporting the at least one tucking finger to slide upwardly along the plurality of rails.

23. The end flap engagement assembly of claim 22, wherein the second cam follower is operably coupled to a gearbox, the gearbox in mechanical communication with a gear intermeshed with at least a portion of at least one adjustment rod supporting the at least one tucking finger such that the second cam follower is arranged to move along the at least one downwardly-extending segment of the second cam track to cause the at least one adjustment rod to move away from the carrier, and such that the second cam follower is arranged to move along the at least one upwardly-extending segment of the second cam track to cause the at least one adjustment rod to move along the machine direction toward the carrier.

* * * * *